US010702058B1

(12) United States Patent
Wang

(10) Patent No.: US 10,702,058 B1
(45) Date of Patent: Jul. 7, 2020

(54) STABLE LIFTING STRUCTURE OF LIFTING DESK

(71) Applicant: CHU HSING METAL CO., LTD., Changhua County (TW)

(72) Inventor: Kuan-Chuan Wang, Changhua County (TW)

(73) Assignee: GRAND-TEK TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/511,952

(22) Filed: Jul. 15, 2019

(51) Int. Cl.
*A47B 9/20* (2006.01)
*A47B 9/10* (2006.01)
*A47B 21/02* (2006.01)

(52) U.S. Cl.
CPC ..... *A47B 9/20* (2013.01); *A47B 9/10* (2013.01); *A47B 21/02* (2013.01)

(58) Field of Classification Search
CPC .... A47B 9/00; A47B 9/02; A47B 9/08; A47B 9/14; A47B 9/20; A47B 9/10; A47B 9/12; A47B 2200/0051; A47B 2200/0052
USPC ..... 108/144.11, 147, 146, 147.19, 147.21, 108/148, 106; 248/414, 188.5, 188.2, 248/188.1, 188.3
See application file for complete search history.

(56) References Cited

U.S. PATENT DOCUMENTS 3,285,207 A * 11/1966 Vom Hagen ..... A47B 9/083 108/146
3,887,155 A * 6/1975 Bertalot ..... F16B 7/10 248/333
3,905,311 A * 9/1975 Carpentier ..... A47B 9/02 108/136
4,651,652 A * 3/1987 Wyckoff ..... A47B 9/12 108/147
5,553,550 A * 9/1996 Doyle ..... A47B 9/00 108/147
6,092,474 A * 7/2000 Chen ..... A47B 9/10 108/147
6,327,985 B1 * 12/2001 Frenkler ..... A47B 9/00 108/147.19
6,345,547 B1 * 2/2002 Stoelinga ..... A47B 9/06 108/147
6,478,269 B2 * 11/2002 Forsberg ..... A47B 9/00 108/147.19
8,430,218 B2 * 4/2013 Klinke ..... A47B 9/20 188/300

(Continued)

FOREIGN PATENT DOCUMENTS

TW 103218945 6/2015

*Primary Examiner* — Jose V Chen
(74) *Attorney, Agent, or Firm* — Chun-Ming Shih

(57) ABSTRACT

A stable lifting structure of a lifting desk contains: a first tube and a second tube movably fitted with the first tube so as to form a movable desk leg. The first tube includes a base, and the second tube includes a limitation sleeve. A movable cylinder is accommodated in the movable desk leg so that a body of the movable cylinder is locked on the first tube, and a column of the movable cylinder is connected on the second tube and is driven to expend or retract by an abutting plate and a pull cable. The first tube includes a slidable sleeve, and an inner diameter of the slidable sleeve corresponds to an outer diameter of the second tube. The slidable sleeve includes multiple recesses, a roll peg is accommodated in each recess, and each roll peg partially exposes outside the second tube via each recess.

3 Claims, 5 Drawing Sheets

(56) References Cited

U.S. PATENT DOCUMENTS

| | | | | |
|---|---|---|---|---|
| 9,144,301 | B2 * | 9/2015 | Riis | A47B 9/20 |
| 9,204,715 | B2 * | 12/2015 | Bonuccelli | A47B 9/20 |
| 9,629,452 | B1 * | 4/2017 | Chen | A47B 9/20 |
| 9,743,755 | B2 * | 8/2017 | Lin | B66F 3/26 |
| 10,342,327 | B2 * | 7/2019 | Lin | A47B 9/10 |
| 2002/0050112 | A1 * | 5/2002 | Koch | A47B 9/20<br>52/651.07 |
| 2007/0137535 | A1 * | 6/2007 | Jones | A47B 9/02<br>108/147 |
| 2011/0168064 | A1 * | 7/2011 | Jahnsen | A47B 9/00<br>108/147 |
| 2015/0047538 | A1 * | 2/2015 | Ergun | A47B 9/02<br>108/147 |
| 2016/0102693 | A1 * | 4/2016 | Wang | A47C 19/024<br>248/161 |
| 2016/0281912 | A1 * | 9/2016 | Christen | F16M 11/26 |
| 2018/0184800 | A1 * | 7/2018 | Yamamoto | A47B 9/20 |
| 2018/0202476 | A1 * | 7/2018 | Wu | F16B 7/14 |
| 2019/0357668 | A1 * | 11/2019 | Knudtson | A47C 3/40 |

* cited by examiner

STABLE LIFTING STRUCTURE OF LIFTING DESK

FIELD OF THE INVENTION

The present invention relates to a stable lifting structure of a lifting desk which is simplified by providing the multiple roll pegs, and the second tube is lifted and descended stably and smooth so as to prolong a service life of the stable lifting structure.

BACKGROUND OF THE INVENTION

A conventional lifting desk contains a first tube, a second tube fitted with the first tube to form a movable leg, and a hydraulic cylinder, wherein a body and a column of the hydraulic cylinder are connected on a top of the second tube and a bottom of the second tube respectively so that the column of the hydraulic retracts inward or expands outward to drive the second tube to extend upward or retracts downward, thus adjusting a height of a desktop.

Another conventional lifting desk is disclosed in TW Utility Model No. 103218945 and contains a first tube and a second tube fitted with the first tube to form a movable leg, multiple roller arranged on an inner rim of an upper end of the second tube so as to guide the second tube to lift and descend smoothly. The second tube has a base arranged on a lower end thereof, and a cylinder mounted in the movable leg so that a bottom of the body is fixed on the lower end of the second tube, and a top of the column is coupled with an upper end of the second tube. The upper end of the second tube is rotatably connected with a control rod by using a connection seat, and the control rod is operated to abut against the column of the cylinder so that the column retracts inward or expand outward, and the movable leg is driven by the column to extend or retract, thus adjusting a height of a desktop.

To lift or descend the second tube stably after the cylinder actuates the second tube, the multiple rollers of the first tube contacts with an outer surface of the second tube, but the multiple rollers cannot contact with the outer surface of the second tube matingly, thus moving the second tube unstably. In addition, the multiple rollers are broken after a period of using time, so it is necessary to adjust or replace the multiple rollers.

The present invention has arisen to mitigate and/or obviate the afore-described disadvantages.

SUMMARY OF THE INVENTION

The primary aspect of the present invention is to provide a stable lifting structure of a lifting desk which is simplified by providing the multiple roll pegs, and the second tube is lifted and descended stably and smooth so as to prolong a service life of the stable lifting structure.

To obtain the above aspect, a stable lifting structure of a lifting desk provided by the present invention contains: a first tube and a second tube movably fitted with the first tube so as to form a movable desk leg.

The first tube includes a base formed on a bottom thereof, and a top of the second tube is locked on a desktop, wherein a size and a shape of the desktop are changeable, the second tube includes a limitation sleeve fitted on a bottom thereof so as to avoid a removal of the second tube from the first tube, a movable cylinder is accommodated in the movable desk leg which is formed by the first tube and the second tube so that a body of the movable cylinder is locked on the bottom of the first tube, and the body is connected with the bottom of the first tube, a top of a column is connected on an upper end of the second tube, the column of the movable cylinder is driven to expend or retract by an abutting plate and a pull cable, and the second tube of the movable desk leg lifts and descends to adjust a height of a desktop.

The first tube includes a slidable sleeve fitted on a top thereof, an inner diameter of the slidable sleeve corresponds to an outer diameter of the second tube so that the second tube is fitted with the first tube via the slidable sleeve, wherein the slidable sleeve includes multiple recesses defined around a peripheral side thereof, wherein a roll peg is accommodated in each of the multiple recesses, each roll peg partially exposes outside the second tube via each recess, and each roll peg rolls in each recess smoothly, such that the second tube is driven by the movable cylinder to lift or descend smoothly and stably.

DETAILED DESCRIPTION OF THE PREFERRED EMBODIMENTS

Figure 1:
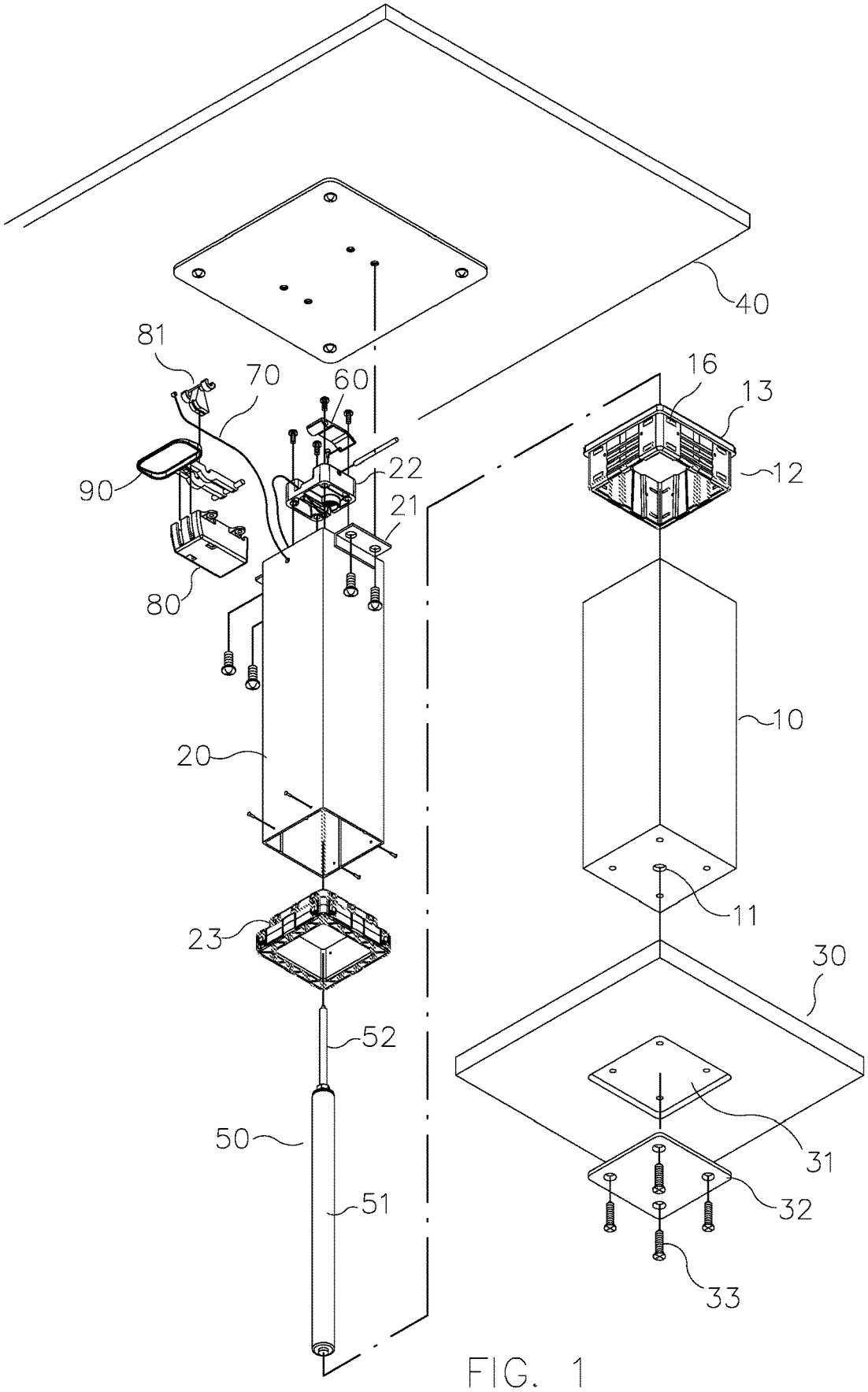
FIG. 1 is a perspective view showing the exploded components of a stable lifting structure of a lifting desk according to a preferred embodiment of the present invention.
Figure 3:
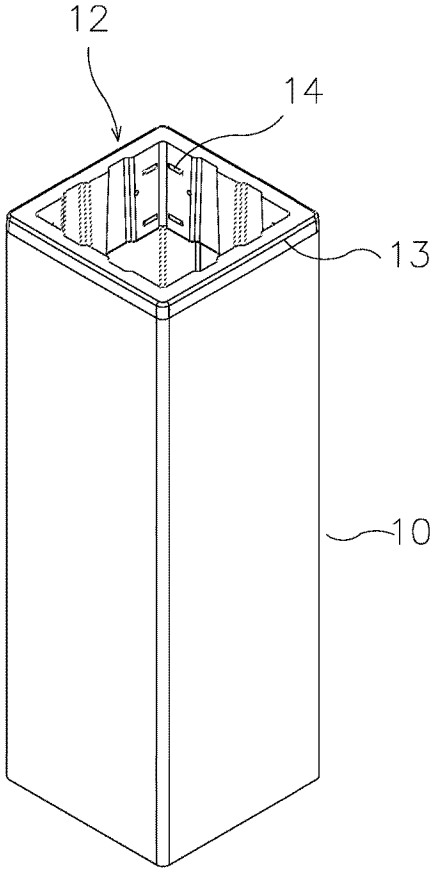
FIG. 3 is a perspective view showing the assembly of a part of the stable lifting structure of the lifting desk according to the preferred embodiment of the present invention.
Figure 2:
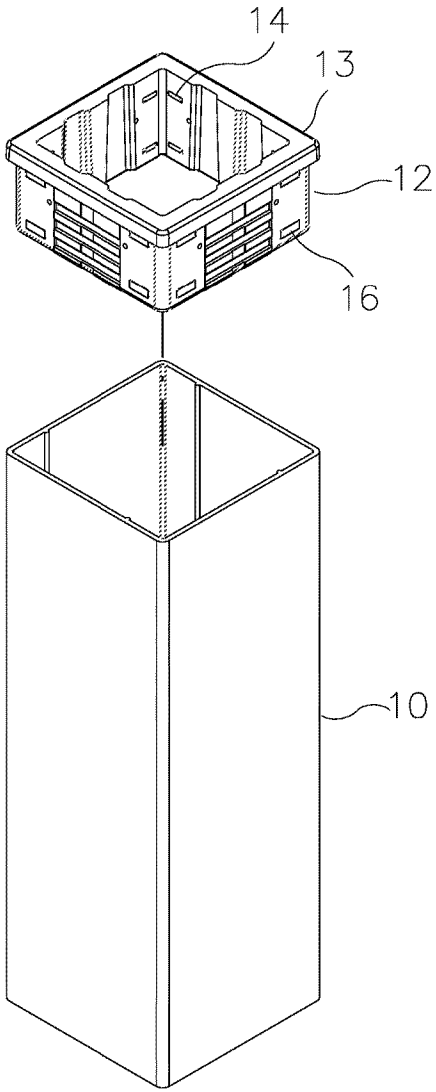
FIG. 2 is a perspective view showing the exploded components of a part of the stable lifting structure of the lifting desk according to the preferred embodiment of the present invention.
Figure 5:
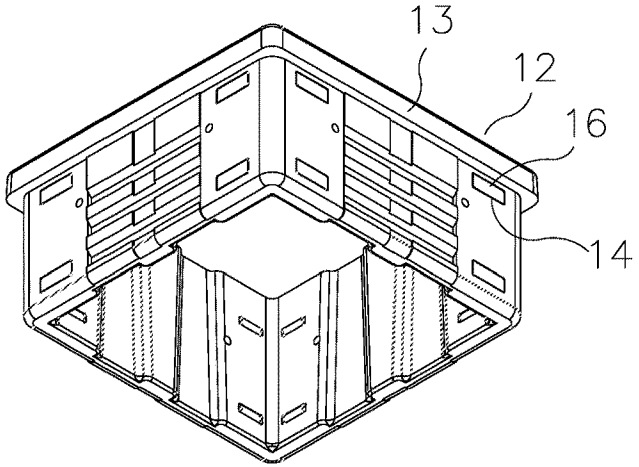
FIG. 5 is another perspective view showing the assembly of a part of the stable lifting structure of the lifting desk according to the preferred embodiment of the present invention.
Figure 6:
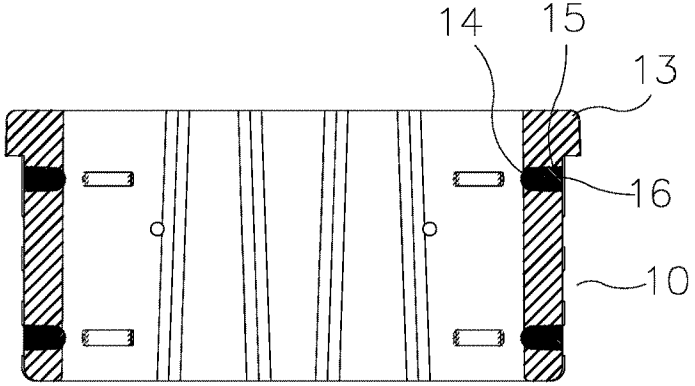
FIG. 6 is also another cross sectional view showing the assembly of a part of the stable lifting structure of the lifting desk according to the preferred embodiment of the present invention.
Figure 4:
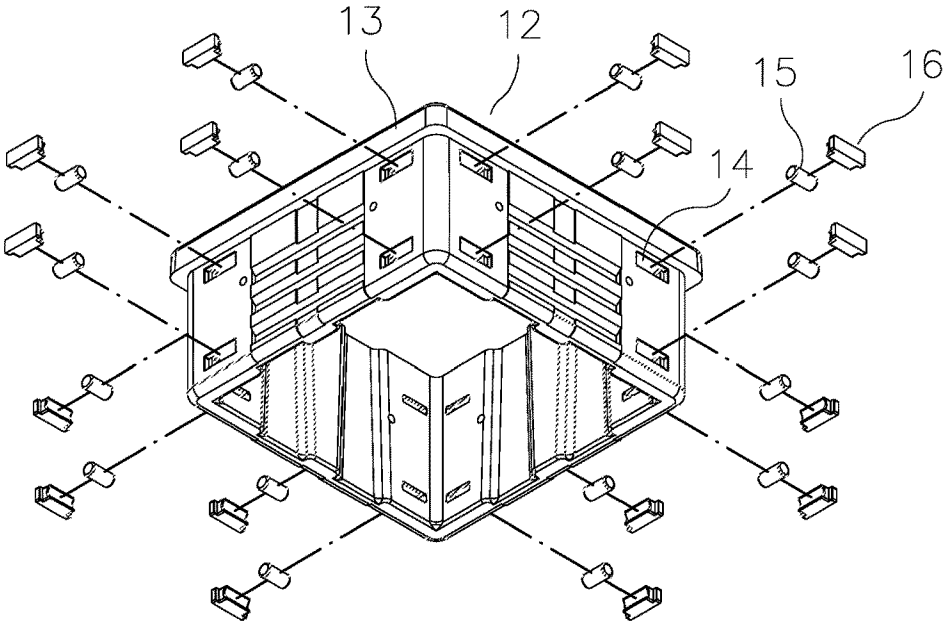
FIG. 4 is another perspective view showing the exploded components of a part of the stable lifting structure of the lifting desk according to the preferred embodiment of the present invention.
Figure 7:
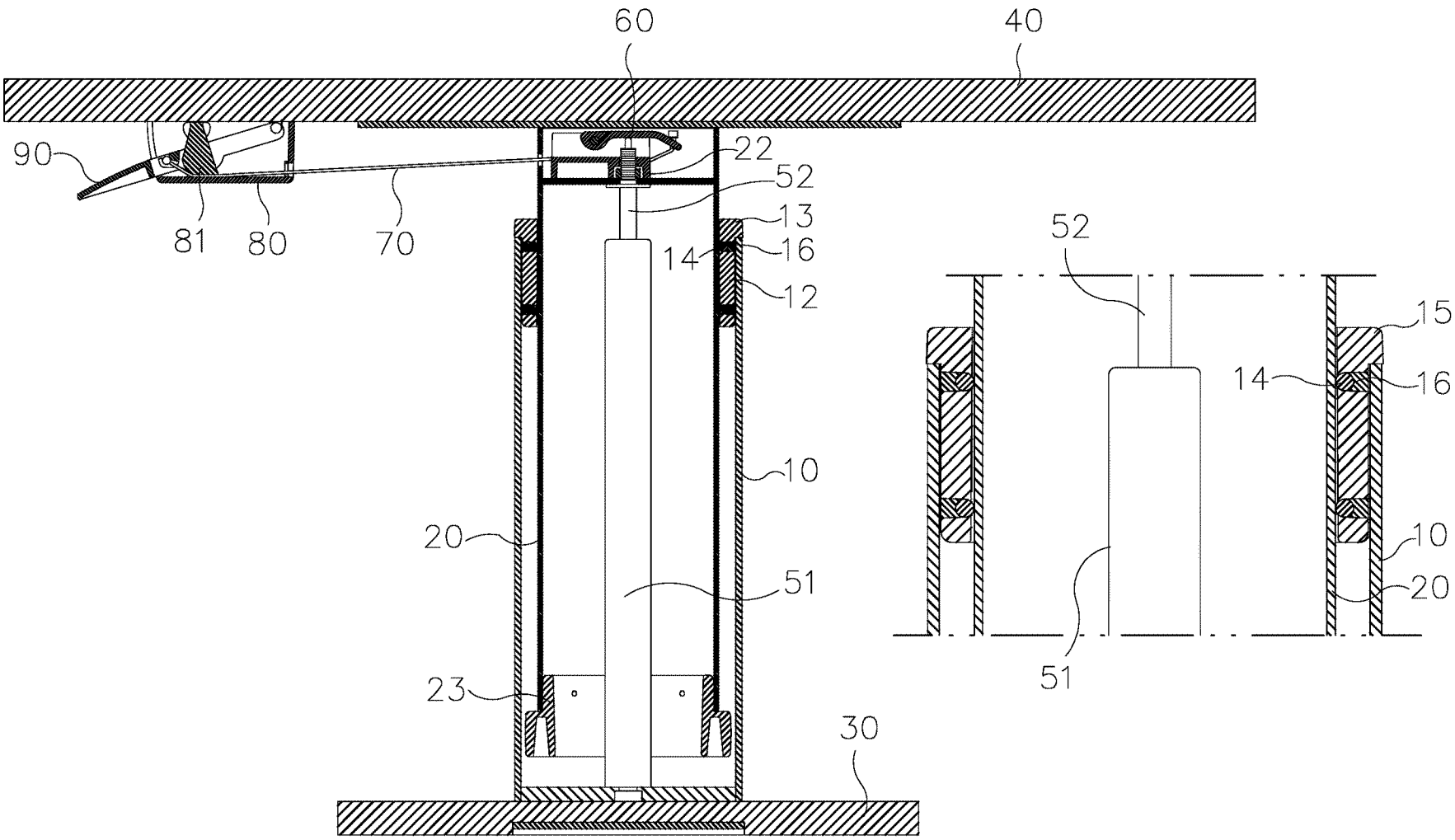
FIG. 7 is a cross sectional view showing the operation of the stable lifting structure of the lifting desk according to the preferred embodiment of the present invention.
Figure 8:
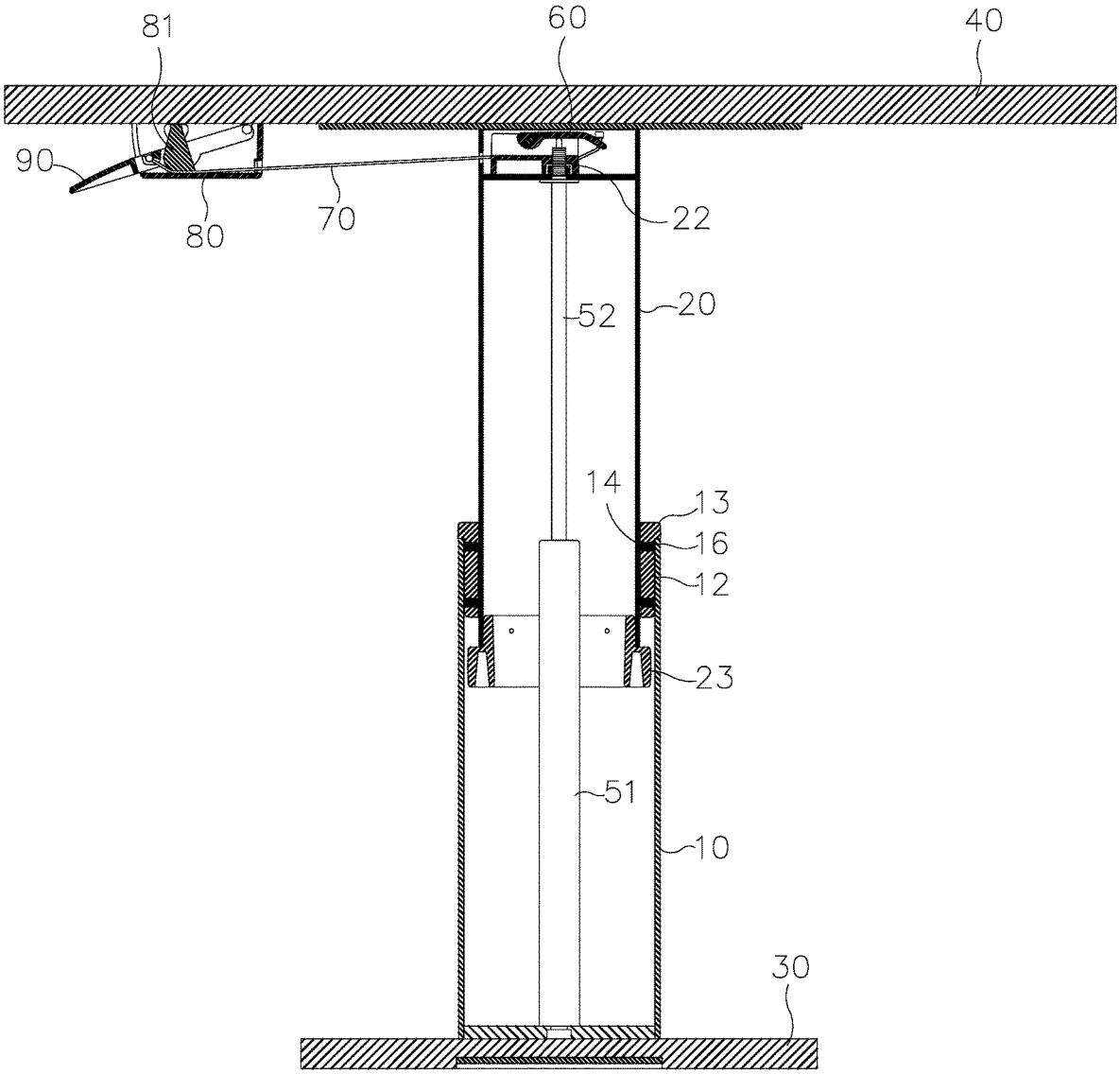
FIG. 8 is another cross sectional view showing the assembly of the stable lifting structure of the lifting desk according to the preferred embodiment of the present invention.

With reference to FIGS. 1-8, a stable lifting structure of a lifting desk according to a preferred embodiment of the present invention comprises: a first tube 10 and a second tube 20 movably fitted with the first tube 10 so as to form a movable desk leg. The first tube 10 includes a base 30 formed on a bottom thereof. The base 30 includes a locking groove 31 defined a bottom thereof, a positioning plate 32 retained in the locking groove 31, and four screws 33 screwed to the bottom of the first tube 10. A top of the second tube 20 is locked on a positioning plate 41 of the desktop 40 by ways of a wing sheet 21, wherein a size and a shape of the desktop 40 is changeable. The second tube 20 includes a limitation sleeve 23 fitted on a bottom thereof so as to avoid a removal of the second tube 20 from the first tube 10. A movable cylinder 50 is accommodated in the movable desk leg which is formed by the first tube 10 and the second tube 20 so that a body 51 of the movable cylinder 50 is locked on a threaded orifice 11 on a bottom of the first tube 10, and the body 51 is connected with the bottom of the first tube 10, a top of a column 52 is connected on and extends out of a fixer 22 on an upper end of the second tube 20. An abutting plate 60 is rotatably connected with a top of the fixer 22, a bottom of the abutting plate 60 contacts with an engagement button on the top of the column 52 of the movable cylinder 50, and a pull cable 70 is connected at a predetermined position of a free end of the abutting plate 60. The pull cable 70 is flexible and extends to the desktop 40. The desktop 40 includes a protective cover 80 arranged on a predetermined position of a peripheral side of the desktop 40. The protective cover 80 includes a pulling protrusion 90 and a guide seat 81 so that when the pulling protrusion 90 is pulled, the pull cable 70 is guided by the guide seat 81 to drive the abutting plate 60 to swing and to contact with the engagement button of the column 52 of the movable cylinder 50, and the column 52 of the movable cylinder 50 is driven to expend or retract, such that the second tube 20 is lift and descend so as to adjust a height of the lifting desk.

The first tube 10 includes a slidable sleeve 12 fitted on a top thereof, wherein an outer diameter of the slidable sleeve 12 corresponds to an inner diameter of the first tube 10, and the slidable sleeve 12 has a peripheral rib 13 extending around a top thereof and being more than the inner diameter of the first tube 10 so that the slidable sleeve 12 is fitted with the first tube 10. Since the diameter of the slidable sleeve 12 matches with the second tube 20, the second tube 20 is fitted with the first tube 10 via the slidable sleeve 12. The slidable sleeve 12 includes multiple recesses 14 defined around a peripheral side thereof, wherein an inner opening of each of the multiple recesses 14 is less than an outer opening of each recess 14 so that a roll peg 15 is accommodated in each recess 14, and a cap 16 covers the outer opening of each recess 14 to stop the roll peg 15, such that each roll peg 15 partially exposes outside the second tube 20 via each recess 14, and each roll peg 15 rolls in each recess 14. The second tube 20 is driven by the movable cylinder 50 to lift or descend smoothly and stably. Preferably, the roll peg 15 of the slidable sleeve 12 facilitates simplification and connection accuracy of the stable lifting structure. A service life of the stable lifting structure is prolonged.

Accordingly, the stable lifting structure of the lifting desk is simplified by providing the multiple roll pegs, and the second tube is lifted and descended stably and smooth so as to prolong its service life.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A stable lifting structure of a lifting desk, comprising:

a first tube and a second tube movably fitted with the first tube so as to form a movable desk leg, the first tube including a base formed on a bottom thereof, and a top of the second tube being locked on a desktop, wherein a size and a shape of the desktop are changeable, the second tube includes a limitation sleeve fitted on a bottom thereof so as to avoid a removal of the second tube from the first tube, a movable cylinder is accommodated in the movable desk leg which is formed by the first tube and the second tube so that a body of the movable cylinder is locked on the bottom of the first tube, and the body is connected with the bottom of the first tube, a top of a column of the movable cylinder is connected on an upper end of the second tube, a pull cable is connected with an abutting plate, the abutting plate is driven by the pull cable to contact with the column of the movable cylinder, and the column of the movable cylinder is driven to expand or retract, such that the second tube of the movable desk leg lifts and descends to adjust a height of a desktop;

wherein the first tube includes a slidable sleeve fitted on a top thereof, an inner diameter of the slidable sleeve corresponds to an outer diameter of the second tube so that the second tube is fitted with the first tube via the slidable sleeve, wherein the slidable sleeve includes multiple recesses defined around a peripheral side thereof, wherein a roll peg is accommodated in each of the multiple recesses, each roll peg partially exposes outside the second tube via each recess, and each roll peg rolls in each recess smoothly, such that the second tube is driven by the movable cylinder to lift or descend smoothly and stably.

2. The stable lifting structure of the lifting desk as claimed in claim 1, wherein the slidable sleeve has a peripheral rib extending around a top thereof and being more than the inner diameter of the first tube so that the slidable sleeve is fitted with the first tube.

3. The stable lifting structure of the lifting desk as claimed in claim 1, wherein the slidable sleeve includes multiple recesses defined around a peripheral side thereof, an inner opening of each of the multiple recesses is less than an outer opening of each recess so that a roll peg is accommodated in each recess, and a cap covers the outer opening of each recess to stop the roll peg, such that each roll peg partially exposes outside the second tube via each recess, and each roll peg rolls in each recess smoothly.

* * * * *